United States Patent [19]

Mercer et al.

[11] Patent Number: 4,706,824

[45] Date of Patent: Nov. 17, 1987

[54] VARIABLE SIZED FREE STANDING PROMOTIONAL DISPLAY

[75] Inventors: John E. Mercer; R. Christopher Kidd, both of New York, N.Y.; Milton Merl, Belleville, N.J.

[73] Assignee: Marlboro Marketing, Inc., New York, N.Y.

[21] Appl. No.: 843,538

[22] Filed: Mar. 25, 1986

[51] Int. Cl.[4] ..... A47F 5/00

[52] U.S. Cl. ..... 211/188; 108/111; 211/153; 211/186

[58] Field of Search ..... 211/188, 194, 186, 187, 211/153; 108/111, 91

[56] References Cited

U.S. PATENT DOCUMENTS

| | | | |
|---|---|---|---|
| 3,964,810 | 6/1976 | Murphy | 211/188 X |
| 3,986,616 | 10/1976 | Gray | 211/153 |
| 4,467,927 | 8/1984 | Nathan | 211/188 X |
| 4,474,416 | 10/1984 | Rogahn | 108/111 X |
| 4,574,709 | 3/1986 | Lacker et al. | 211/186 X |

FOREIGN PATENT DOCUMENTS

| | | | |
|---|---|---|---|
| 759799 | 5/1967 | Canada | 211/126 |

*Primary Examiner*—Robert W. Gibson, Jr.
*Attorney, Agent, or Firm*—Wolder, Gross & Yavner

[57] ABSTRACT

A variable sized free standing promotional display for promotional advertising. In place of the normal cardboard display shelf of one size, the invention contemplates using end members of plastic having vertical pedestals above and below the end members. The end members include one-way locking tabs on both the side, upper and lower walls to receive an appropriately slotted and cut beam member, which may be made of corrugated cardboard from the packing materials. The side edges of the beam are received and locked by the one-way locking tabs and is centered and held rigidly by central vertical channels. The transverse length of the shelves may be varied, in accordance with the length of the beam member utilized.

Vertical cardboard columns may be anchored on the pedestal members to provide a vertical promotional display of more than one shelf.

15 Claims, 5 Drawing Figures

VARIABLE SIZED FREE STANDING PROMOTIONAL DISPLAY

BACKGROUND OF THE INVENTION

The present invention relates to new and improved promotional advertising displays, and more particularly to a free standing promotional display which is pleasing in appearance and may be adapted for a plurality of tranverse shelf lengths.

The trend for displaying merchandise in retail stores is away from fixed displays and towards to temporary displays. This is known as promotional advertising and generally consists of promotional material pre-packed within corrugated shipping boxes for the merchandise. This can be observed in any retail operation, whether it is the sale of shampoos, pretzels, soda, etc. The manufacturers and packers are concentrating on how to do a better job with these promotional displays.

The use of corrugated packaging for promotional displays, probably is from the time of the availability of boxes and requiring means to cut them into desired displays without fully removing the goods from the shipping containers.

Promotional displays have advanced to the point of presenting the merchandise free of the actual packing container. However, the appearances are limited to the look of the packing materials and to the dimensions of the packing materials. This is particularly true with respect to shelves. Creating a free standing shelf display with a plurality of shelves presents a series of undesirable problems.

The major problem is that the shelf is limited to the actual dimensions of the cardboard beams formed from the packing materials. Of course it is possible to make a plastic shelf which is more attractive, but plastic is at least four times as expensive as cardboard to fabricate for these purposes. Furthermore, the dimensions are limited to the size of the packing materials, and the cost for preparing the mold for such a shelf is quite prohibitive.

Another problem with the cardboard displays is that they are unattractive in appearance. In addition to being unattractive, because they are made out of corrugated strengthened paper, they do appear flimsy and they lack the rigidity that is present in a permanent display or a full plastic display.

Furthermore, because of the lack of rigidity the unit tends to be somewhat unstable, and should there be too heavy a load on the upper shelves, it is possible that the unit may ultimately twist, tilt, tip, or collapse.

It is therefore an object of the present invention to provide an improved variable sized free standing promotional display.

Another object of the present invention is to provide a promotional display in which the transverse lengths of the shelves may be varied.

Still yet another object of the present invention is to provide an improved promotional display which is stable and provides firm vertical support for a plurality of shelves.

Still yet another further object of the present invention is to provide a promotional display unit whose end members are formed of plastic with a transverse carqboard beam member, creating a solid structure, having rigidily.

Still yet a further object of the present invention is to provide an improved device of the character described which presents a pleasing appearance.

Still yet a further object of the present invention is to provide an improved free standing promotional display which presents a solid, yet pleasing appearance to the viewer.

Still yet another object of the present invention is to provide an improved variable sized free standing promotional display which will be simple and economical to manufacture and yet be durable and aesthetically pleasing when put in use.

BRIEF DESCRIPTION OF THE INVENTION

The present invention presents an interesting and intriguing solution to the problems existing in the prior art. The shelf is formed of plastic end members having a predetermined width. Therefore, the width of the shelf will not vary. The end members are formed with pedestals on both the top and the bottom at proximate its extremities. Cardboard columns may be wedged on the pedestals in order to provide spacing between the end members. The end members also have a series of one-way locking tabs on all walls designed to receive a cardboard beam member formed from the packing materials. The beam member is designed in the style of a standard "I-beam" and consists of an upper surface, side walls, bottom walls, central vertical members and upwardly extending support underwalls. The beams also include a series of slots and holes mating with those of the tabs and the reinforcing ribs in order to be accommodated within the end members. The holes are engaged in one-way tabs for locking purposes, and the central support walls engage the channel again for strengthening the engagement of the beam member with the end walls. The two end members and the beam form a shelf, and the vertical columns wedged on the pedestals form spacing between the shelves, thus forming a free standing display of one or more shelves. The bottom shelf may utilize the lower pedestals as support to the floor. The combination shelf may be color coordinated, and the whole unit is a significant advance over the present state of promotional advertising.

The above description, as well as further objects and advantages of the present invention will be more fully appreciated with reference to the following detailed description of a preferred, but nonetheless illustrative embodiment of the invention, when taken in conjunction with the following drawings, wherein.

DETAILED DESCRIPTION OF THE INVENTION

Figure 1:
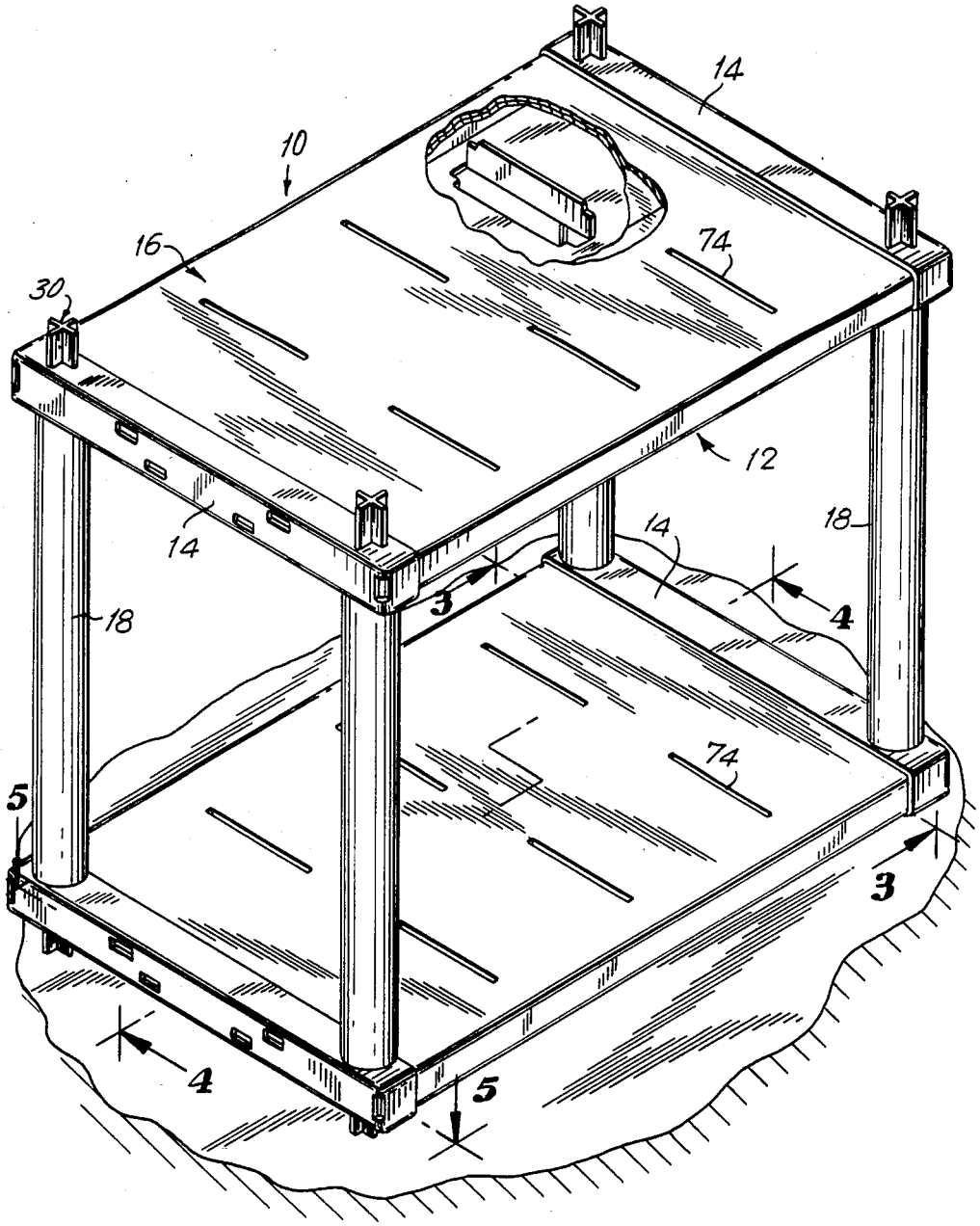
Figure 1 is a front perspective view, partly cut away, of a variable sized free standing promotional display embodying our invention.

Turning in detail to the drawings, and more particularly to FIG. 1, there is shown a variable sized free standing promotional display 10 broadly comprising a shelf 12 formed of end members 14 and a beam member 16. The shelves are separated by vertical support columns 18.

Figure 2:
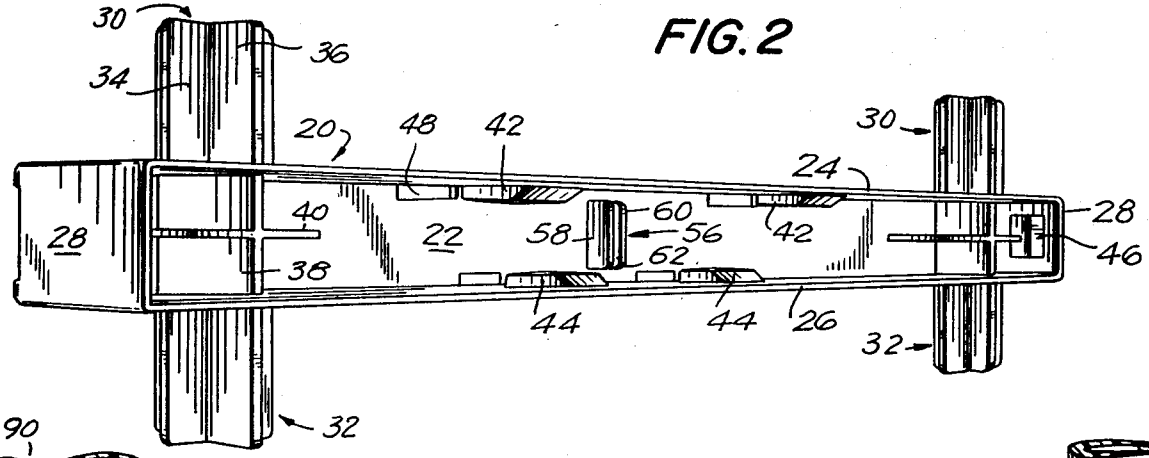
FIG. 2 is a front perspective view of an end member, showing the interior locking tabs.

Turning to the end member 14, and as seen in FIG. 2, the member is broadly formed of a receptacle 20 defined by a rear or end wall 22, a top wall 24, a bottom wall 26, and side walls 28. Positioned near the walls 28 are top and bottom pedestals 30, 32. The pedestals are formed of perpendicular first ribs 34 and perpendicular second ribs 36. The ribs 34 do not extend through the receptacle 20, but the ribs 36 are reinforced by means of vertical interior rib 38. It is also desirable, but optional, to add a horizontal stiffening rib 40 within the receptacle. Located within the receptacles are a plurality of top, bottom, and side wall locking tabs 42, 44, and 46. Located in the end wall 22 are a series of windows 48 facing the tabs. The sole purpose of these windows is to facilitate the molding of the end member.

Turning to the tabs themselves, they are formed of an incline 50 (FIG. 4), a parallel wall 52, parallel to the top and bottom walls 24, 26, and a locking wall 54. It is thus obvious that a unit may be slipped into the receptacle, with an opening passing over the incline wall 50, along the parallel wall 52, and then dropping into place and abutting the locking wall 54.

Finally, the end member is formed with a vertical channel member 56, formed of left and right walls 58, 60 defining a slot 62.

The beam member 16 is formed directly from the corrugated packing materials forming the packing box. It may be part of the actual side panels, or be part of an interior liner panel. The beam has a series of scores allowing appropriate folding to form what is essentially an "I-beam" construction. The beam also has a series of openings and slots in order to accommodate the structure of the end member. The beam member generally comprises a top wall 64, side walls 66, bottom walls 68, central support walls 70 and under walls 72. The top wall 64 may have a series of slots 74 receiving lower wall tabs 76 (FIG. 1) with a step shoulder in order to provide additional stability within the beam member 16.

In order to accommodate the ribs and locking tabs of the end members 14, the beam member at its end (FIGS. 4 and 5) has upper and lower horizontal slots 78, 80 to accomodate the vertical ribs 38. Furthermore, the end portions have a series of upper, bottom, and side openings 82, 84, 86 to accommodate the top, bottom and side locking tabs 42, 44, 46.

Figure 3:
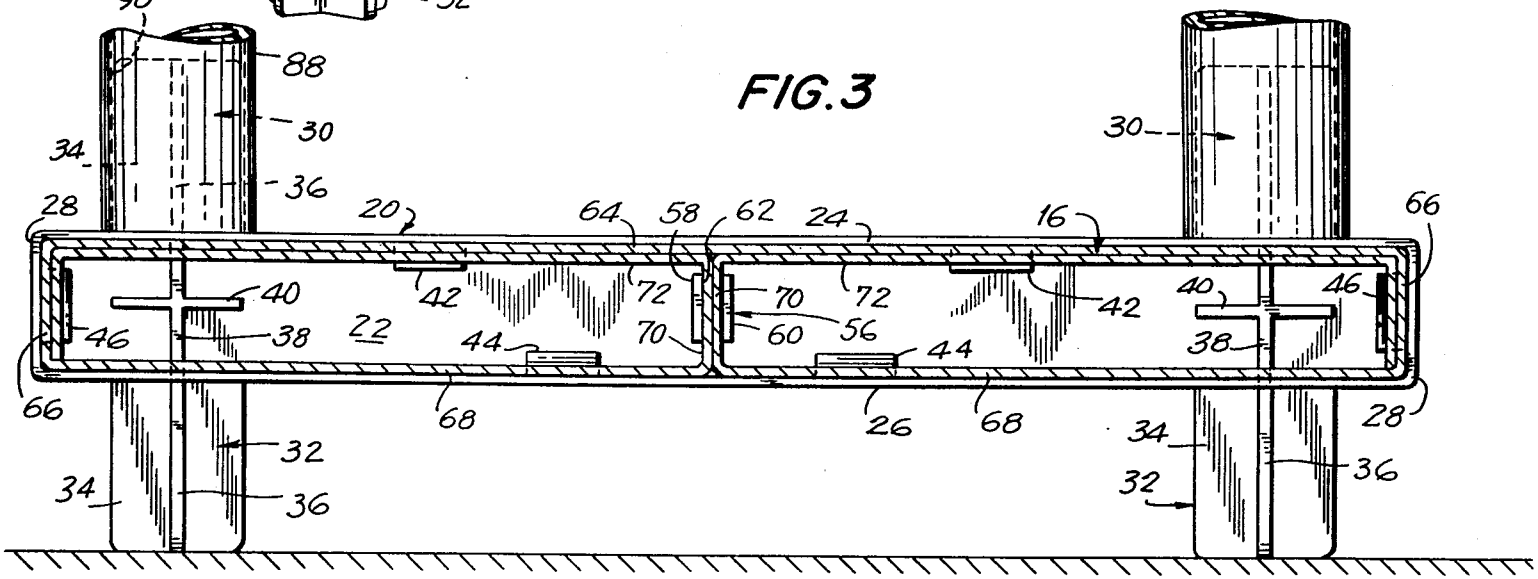
FIG. 3 is an enlarged elevational view, partly cut away, taken along the line 3—3 of FIG. 1.
Figure 4:
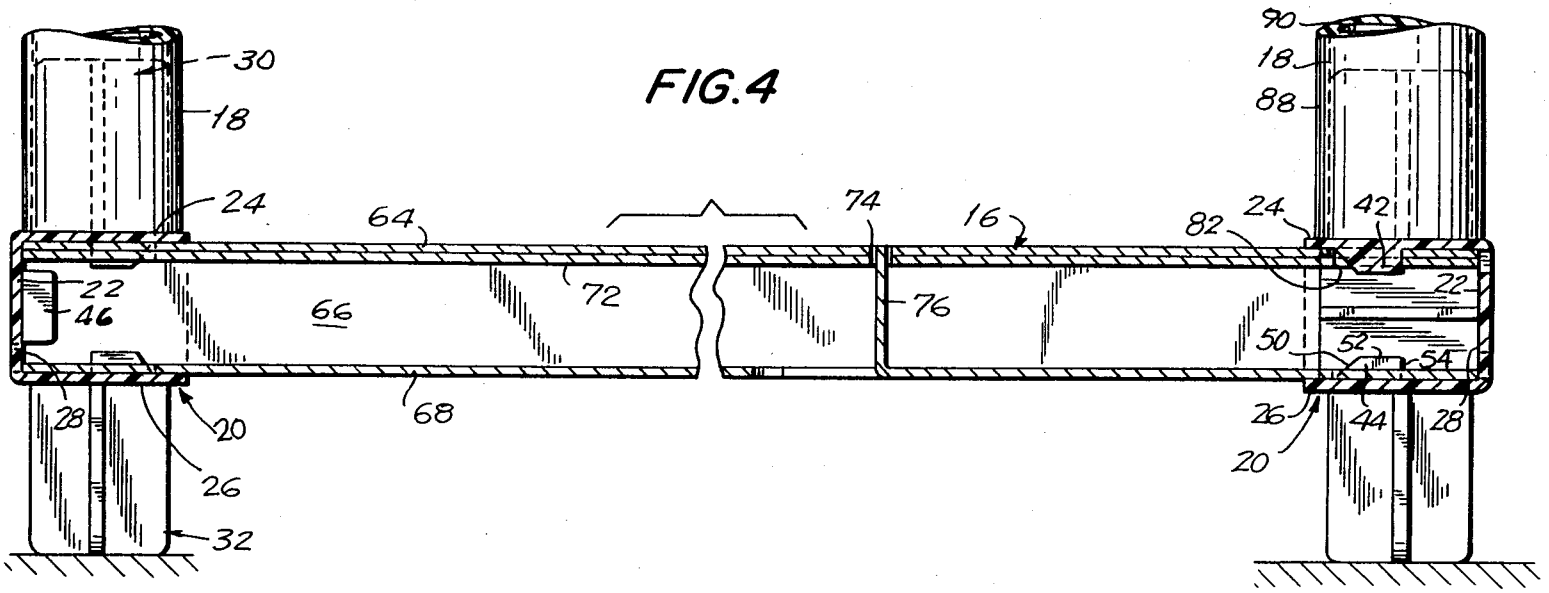
Figure 4 is an enlarged elevational view, partly cut away, taken along the line 4—4 of FIG. 1.
Figure 5:
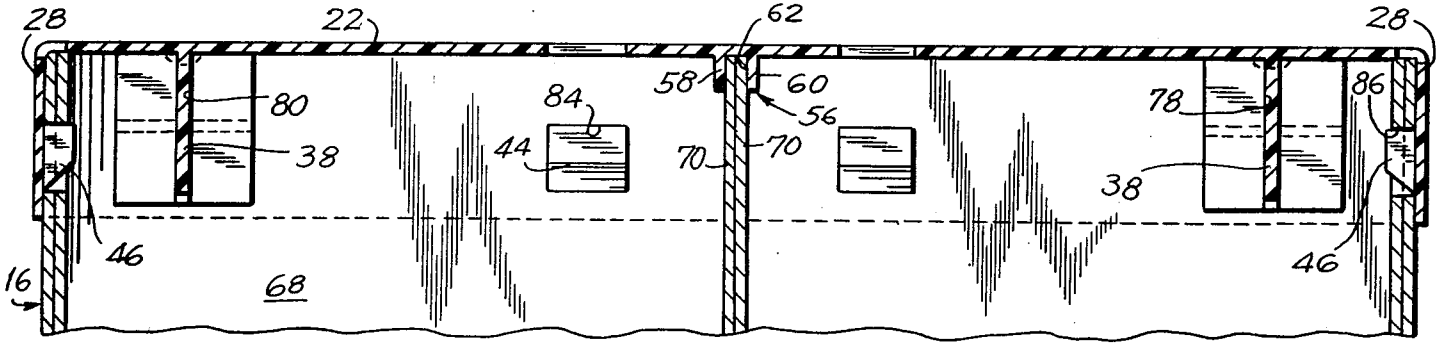
Figure 5 is an enlarged plan view, partly cut away, taken along the line 5—5 of FIG. 1.

The columns 18 are generally hollow cylindrical members having an inner diameter just slightly smaller than that of the horizontal lengths of the ribs 34, 36. Thus, when the columns are forced down on the pedestals, the cardboard gives slightly causing a more rigid and stable engagement between the ribs and the column. As seen in FIGS. 3 and 4, the column is defined by outer wall 88 and inner wall 90.

In order to utilize the present invention, the packaging material is taken apart for assembly. First of all, the end members are placed to the side and the beam member 16 is folded to form the side wall 66 depending from the top wall 64, and then folded again so that the bottom walls 68 are formed parallel to the top wall 64. The member is folded once again to form the central vertical support wall 70 and the under wall 72. The unit is then held together and pushed into position within the receptacle 20 of the end member 14, the slot 78,80 engage the ribs 38, and the openings 82, 84, 86 are passed over the incline 50, and along the wall 52, they are sized so that the opening then drops down against the locking wall 54 and against the lower wall 26, in the case of the lower tabs, the side walls 28, in the case of the side tabs, and the top wall 24, in the case of the top wall tabs, making abutting engagement with the wall and preventing withdrawal of the beam. The central support walls 70 are positioned within the slot 62 formed by the walls 58, 60 of channel 56. This anchors the "I-beam" construction. The tabs 76 may be folded upwardly into the slot 74 for additional rigidity.

The bottom shelf may then be placed on the floor with the bottom pedestal 32 on the ground. Columns 18 may be forced on to the top pedestals 30 and then another shelf may be constructed, as seen in FIG. 1, so as to have a plurality of shelves, and in fact have a free standing display with a number of shelves and having a pleasing appearance to the display. The plastic end members, the beams and the columns may be color-coordinated.

As can be seen, the present invention provides a significant advance over the state of the technology. As numerous additions, modifications and constructions can be performed within the scope of the invention, such scope is to be measured by the claims herein.

What is claimed is:

1. A variable size free standing promotional display to attractively present merchandise in a store, away from fixed displays, which comprises:

(a) a shelf, said shelf including opposite end members each having a receptacle;

(b) a beam member including vertically spaced top and bottom walls intergrally formed of manually foldable cardboard shipping carton component web and means to detachably secure the beam member to the end members in order to form the shelf;

(c) means to allow construction of a configuration of at least two shelves in parallel spaced relationship to each other, whereby the promotional displav may be rapidly yet stably formed to pleasingly present merchandise away from a fixed display.

2. A variable sized free standing promotional display to attractively present merchandise in a store, away from fixed displays, which comprises:

(a) a shelf, said shelf including opposite end members each including top, bottom and side walls delineating a receptacle, and pedestal members secured to the top and bottom walls and in alignment with each other; and (b) a beam member and means to detachably secure the beam member to the end members in order to form the shelf, said securing means comprising detachable locking means positioned within each receptacle and including a locking tab having an inwardly to outwardly inclined wall, a parallel wall parallel to the end member top and bottom walls and a locking wall perpendicular to said top and bottom walls of the respective end member; whereby to allow construction of a confirguration of at least two shelves in parallel spaced relationship to each other so that the promotional display may be rapidly and yet stably formed to pleasingly present merchandise away rom a fixed display.

3. A variable sized free standing promotional display to attractively present merchandise in a store away from fixed displays, which comprises:

a shelf, said shelf including end members, each having a receptacle;

a beam member and means to detachably secure the beam member to the end members in order to form the shelf, said beam member including a top wall, side walls depending from the side edges of and perpendicular to the top wall, bottom walls extending inwardly from and perpendicular to the side walls and parallel to the top wall central support walls projecting upwardly from the inner edges of the bottom walls and perpendicular thereto and parallel to the side walls, and under walls extending from the central support walls and terminating short of the end member side walls, the end borders of at least some of said beam top, bottom and side walls having locking tab engagable openings formed therein.

4. A display rack comprising a first pair of longitudinally spaced transversely extending parallel end members having confronting sockets formed therein, vertical posts depending from the ends of said end members and a first rectangular shelf defining a tubular beam formed of a manually foldable shipping carton web, the ends of said beam telescoping into said end me sockets.

5. The invention according to claim 1 comprising a pair of vertically spaced parallel upper and lower of said shelves, the end member having pedestal means secured to the top and bottom of said end members, and support members engaging the top pedestals of the lower shelf end members and the bottom pedestals of the upper shelf end members.

6. The invention according to claim 1, including detachable locking means positioned within said receptacles said receptacles for engaging said beam.

7. The invention according to claim 6, each end member further including top, bottom and side walls, pedestal members secured to the top and bottom walls and in alignment with each other.

8. The invention according to claim 3, each the end member including a vertical channel receiving the central vertical support walls of the beam.

9. The invention according to claim 1, the end members being formed of plastic.

10. The invention according to claim 1, the beam member being formed of corrugated cardboard.

11. The invention according to claim 1, the support members being formed of a vertical hollow cylindrical member, and being made of cardboard.

12. The display rack of claim 4 further comprising a second pair of end members similar to and underlying said first pair of end members, the ends of said second pair of end members engaging the bottoms of said posts and a second shelf defining a beam similar in structure to said first beam and having its ends telescoping the sockets of said second pair of end members.

13. The display rack of claim 4 wherein each of said end members includes vertically aligned, post coupling pedestals projecting upwardly and downwardly from opposite ends of said end members.

14. The display rack of claim 4 wherein said end members are formed of a plastic material and said beams are formed of corrugated cardboard.

15. The display rack of claim 4 wherein each of said end members includes orthogonally related top, bottom, side and end walls delineating said socket and inwardly projecting locking tabs integrally formed in at least one of said walls, said beam including top, bottom and side walls, the end borders of at least one of said beam walls having openings engaged by respective of said locking tabs.

* * * * *